US009941635B2

(12) United States Patent
Suzuki et al.

(10) Patent No.: US 9,941,635 B2
(45) Date of Patent: Apr. 10, 2018

(54) CONNECTOR HOUSING

(71) Applicant: YAZAKI CORPORATION, Tokyo (JP)

(72) Inventors: Shogo Suzuki, Shizuoka (JP); Hidenori Kanda, Shizuoka (JP); Takuya Hasegawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/440,729

(22) Filed: Feb. 23, 2017

(65) Prior Publication Data

US 2017/0162983 A1 Jun. 8, 2017

Related U.S. Application Data

(63) Continuation of application No. PCT/JP2015/077371, filed on Sep. 28, 2015.

(30) Foreign Application Priority Data

Sep. 29, 2014 (JP) ..... 2014-199127

(51) Int. Cl.
*H01R 13/639* (2006.01)

(52) U.S. Cl.
CPC ..... *H01R 13/639* (2013.01)

(58) Field of Classification Search
CPC ..... H01R 13/62955; H01R 13/62933
USPC ..... 439/157
See application file for complete search history.

(56) References Cited

U.S. PATENT DOCUMENTS 5,797,758 A 8/1998 Tsuchiya et al.
7,396,241 B2 * 7/2008 Matsuura ..... H01R 13/62955 439/157
8,915,749 B2 * 12/2014 Ikeda ..... H01R 13/62938 439/157
9,033,719 B2 * 5/2015 Shimizu ..... H01R 13/64 439/157
2002/0173184 A1 11/2002 Miyazaki
(Continued)

FOREIGN PATENT DOCUMENTS

JP 9-223540 A 8/1997
JP 2002-324622 A 11/2002
(Continued)

OTHER PUBLICATIONS

International Search Report for PCT/JP2015/077371 dated Dec. 1, 2015.
(Continued)

*Primary Examiner* — Gary Paumen
(74) *Attorney, Agent, or Firm* — Kenealy Vaidya LLP

(57) ABSTRACT

A connector housing includes a housing body and a fitting operation lever that has a swinging portion attached to the housing body rotatably. A part of the rib protruding toward the swinging portion narrows an interval between a curved portion of the housing body and the swinging portion to a predetermined value or below. A part of the rib protruding toward a direction separating from a lower surface of the housing body has a flat face. A distance between the rotary axis of the swinging portion and the flat face is larger than a distance between the rotary axis and a part of an outer circumferential edge of the swinging portion.

2 Claims, 7 Drawing Sheets

(56) References Cited

U.S. PATENT DOCUMENTS

| | | | |
|---|---|---|---|
| 2005/0003690 | A1 | 1/2005 | Fukamachi |
| 2014/0206213 | A1 | 7/2014 | Kato et al. |

FOREIGN PATENT DOCUMENTS

| | | | |
|---|---|---|---|
| JP | 2004-311190 | A | 11/2004 |
| JP | 2012-109047 | A | 6/2012 |
| JP | 2013-73743 | A | 4/2013 |
| JP | 2014-32857 | A | 2/2014 |

OTHER PUBLICATIONS

Japanese Office Action for the related Japanese Patent Application No. 2014-199127 dated Aug. 30, 2016.
Japanese Office Action for the related Japanese Patent Application No. 2014-199127 dated Jun. 28, 2016.

* cited by examiner

CONNECTOR HOUSING

CROSS REFERENCE TO RELATED APPLICATION

This application is a continuation of PCT application No. PCT/JP2015/077371, which was filed on Sep. 28, 2015 based on Japanese Patent Application (No. 2014-199127) filed on Sep. 29, 2014, the contents of which are incorporated herein by reference. Also, all the references cited herein are incorporated as a whole.

BACKGROUND

1. Technical Field

The present invention relates to a connector housing that includes a housing body and a fitting operation lever for fitting the housing body and a mating housing body to each other.

2. Background Art

In the background art, there have been proposed connector housings including fitting operation levers. For example, as shown in FIG. 7, one (hereinafter referred to as "background-art housing 100") of the background-art connector housings includes a housing body 110 and a fitting operation lever 120. The housing body 110 receives terminal fittings connected to end portions of cables 210. The fitting operation lever 120 is attached to side surfaces 111 of the housing body 110 rotatably.

The fitting operation lever 120 has a pair of left and right swinging portions 121, an operating rod portion 122, and cam grooves 123. The pair of left and right swinging portions 121 are attached to the side surfaces 111 of the housing body 110 rotatably. The pair of left and right swinging portions 121 are connected to the operating rod portion 122 so that the operating rod portion 122 can serve as an operating portion for swinging the swinging portions 121. As the swinging portions 121 are swung, connecting pins 313 of a mating housing body 310 are pulled into the cam grooves 123. When the swinging portions 121 of the fitting operation lever 120 are rotated in a state that the housing body 110 and the mating housing body 310 are aligned with each other in a fitting start position, the housing body 110 and the mating housing body 310 are fitted to each other (e.g. see JP-A-9-223540).

A curved portion 114 is formed in each of the side surfaces 111 of the housing body 110 of the background-art housing 100 so that a gap S1 between the curved portion 114 and the corresponding swinging portion 121 increases gradually from a position closer to a rotatory center of the swinging portion 121 toward a circumferential edge portion of the swinging portion 121.

In the background-art housing 100, a foreign substance such as a cable routed around the housing body 110 may be guided by one of the curved portions 114 to intrude into the corresponding gap S1 between the curved portion 114 and the swinging portion 121, and unintended external force may therefore act on the swinging portion 121. When such external force acts on the swinging portion 121, there is a fear of dislocation (detachment) of the fitting operation lever 120 from the housing body 110, damage on the swinging portion 121, etc.

SUMMARY

The present invention has been accomplished in consideration of the aforementioned circumstances. An object of the invention is to provide a connector housing in which a foreign substance can be prevented from getting caught between a curved portion of a side surface of a housing body and a swinging portion of a fitting operation lever, and the fitting operation lever can be prevented from being detached and damaged due to the foreign substance getting caught.

In order to achieve the aforementioned object, the connector housing according to the invention is characterized in the following paragraphs (1) and (2).

(1) A connector housing including:

a housing body; and a fitting operation lever that has a swinging portion attached to the housing body rotatably so that when the swinging portion is rotated in a state that the housing body and a mating housing body are aligned with each other in a fitting start position, the housing body and the mating housing body are fitted to each other, wherein the housing body includes a side surface having a curved portion, a lower surface continuous from the side surface, and a rib, the swinging portion being attached to the side surface, the curved portion being provided so that a distance of the curved portion from the swinging portion increases as a distance of the curved portion from a rotary axis of the swinging portion increases, the rib protruding from the curved portion and the lower surface;

wherein a part of the rib protruding toward the swinging portion narrows an interval between the curved portion and the swinging portion to a predetermined value or below;

wherein a part of the rib protruding toward a direction separating from the lower surface have a flat face which extends over a part between both side surfaces of the housing body; and wherein a distance between the rotary axis of the swinging portion and the flat face of the rib is larger than a distance between the rotary axis of the swinging portion and a part of an outer circumferential edge of the swinging portion being closest to the flat face of the rib.

According to the above configuration, even when a foreign substance such as a cable tends to enter a gap between the curved portion of the side surface of the housing body and the swinging portion of the fitting operation lever, the foreign substance interferes with the rib provided in the curved portion of the side surface of the housing body. As a result, entry of the foreign substance into the gap can be blocked. Accordingly, it is possible to prevent the swinging portion from being detached or damaged due to the foreign substance getting caught between the curved portion of the side surface of the housing body and the swinging portion of the fitting operation lever. Incidentally, the predetermined value may be set, for example, as a value smaller than a minimum outer diameter of the cable etc. routed around the housing body.

According to the above configuration, the outer edge portion of the rib provided protrusively in the curved portion of the side surface of the housing body is located on an outer side than the outer circumferential edge of the swinging portion of the fitting operation lever. Therefore, for example, a foreign substance such as a cable rubbing against an upper surface or a lower surface of the housing body in a width direction (a direction of the rotary axis of the swinging portion) slides on the outer edge portion of the rib so as to be apt to move to a position distant from a boundary between the rib and the swinging portion, and to be apt to jump over the gap in the boundary between the rib and the swinging portion. Therefore, the foreign substance may be made harder to enter the gap than in a case where the outer edge portion of the rib and the outer circumferential edge of the swinging portion are arranged to be flush with each other. Accordingly, it is possible to more surely prevent the foreign substance from getting caught between the curved portion of the side surface of the housing body and the swinging portion of the fitting operation lever.

(2) A connector housing including:

a housing body; and a fitting operation lever that has a pair of swinging portions attached to both side surfaces of the housing body rotatably so that when the pair of swinging portion are rotated in a state that the housing body and a mating housing body are aligned with each other in a fitting start position, the housing body and the mating housing body are fitted to each other, wherein each of the both side surfaces of the housing body has a curved portion being provided so that a gap between the side surface and the swinging portion gradually increases toward a circumferential edge of the swinging portion from a position near a center of a rotary axis of the swinging portion;

wherein a pair of ribs protruding toward the pair of swinging portions along a width direction of the housing body are provided on the curved portions of the both side surfaces so as to narrow gaps between each of the curved portions and each of the swinging portions to a predetermined value or below;

wherein one flat face continuously extends in the width direction of the housing body is configured by outer edge faces of the pair of ribs and outer edge face of the housing body positioned between the outer edge portions of the pair of ribs; and wherein each of the outer edge faces of the pair of ribs and the circumferential edge of the corresponding swinging portion are aligned in the width direction of the housing body so as to be flush with each other.

According to the invention, it is possible to prevent a foreign substance from getting caught between the curved portion of the side surface of the housing body and the swinging portion of the fitting operation lever so that it is possible to prevent the fitting operation lever from being detached or damaged due to the foreign substance getting caught.

The invention has been described above briefly. Further, when undermentioned modes (hereinafter referred to as "embodiments") for carrying out the invention are read through with reference to the accompanying drawings, details of the invention can be made further clear.

DETAILED DESCRIPTION OF THE EXEMPLARY EMBODIMENTS

Embodiments of a connector housing according to the invention will be described below in detail with reference to the drawings.

First Embodiment

Figure 1:
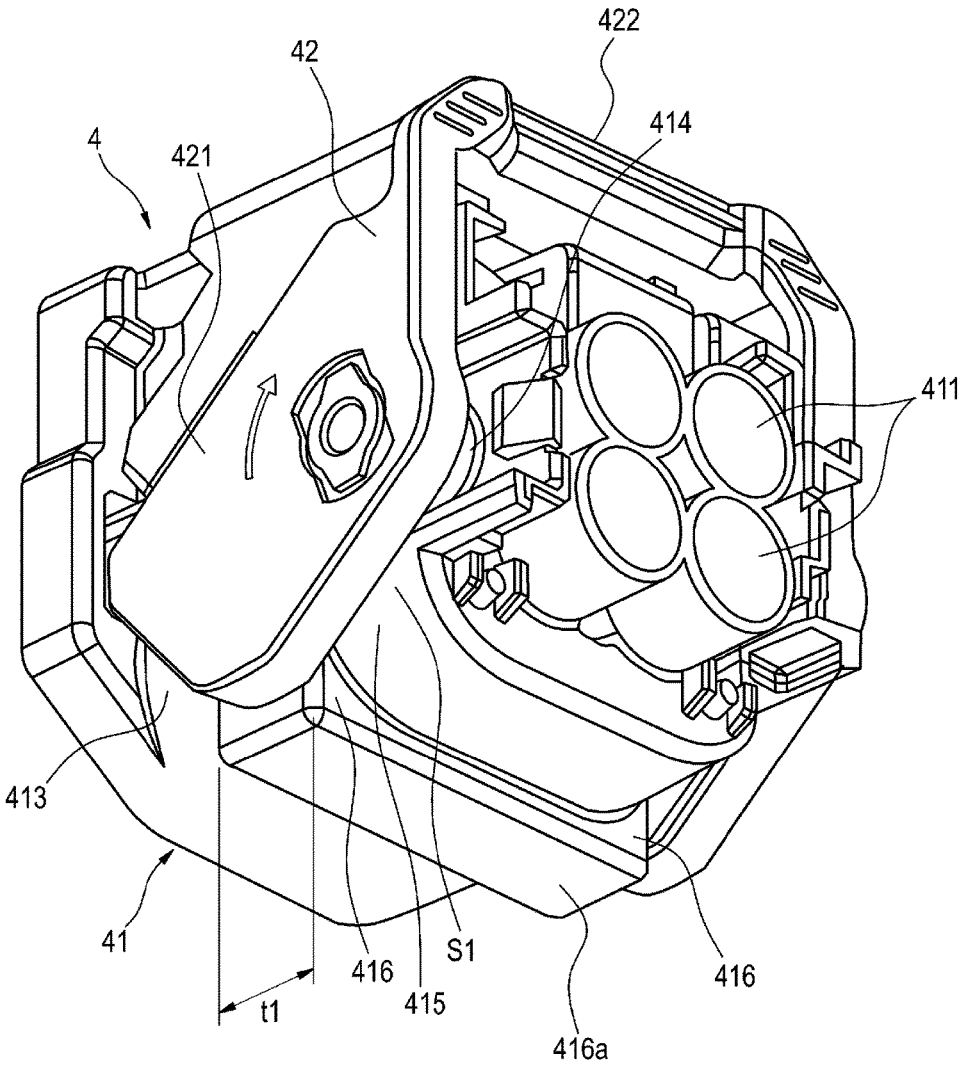
FIG. 1 is a perspective view of a connector housing according to a first embodiment of the invention, as seen obliquely from behind and below.
Figure 2:
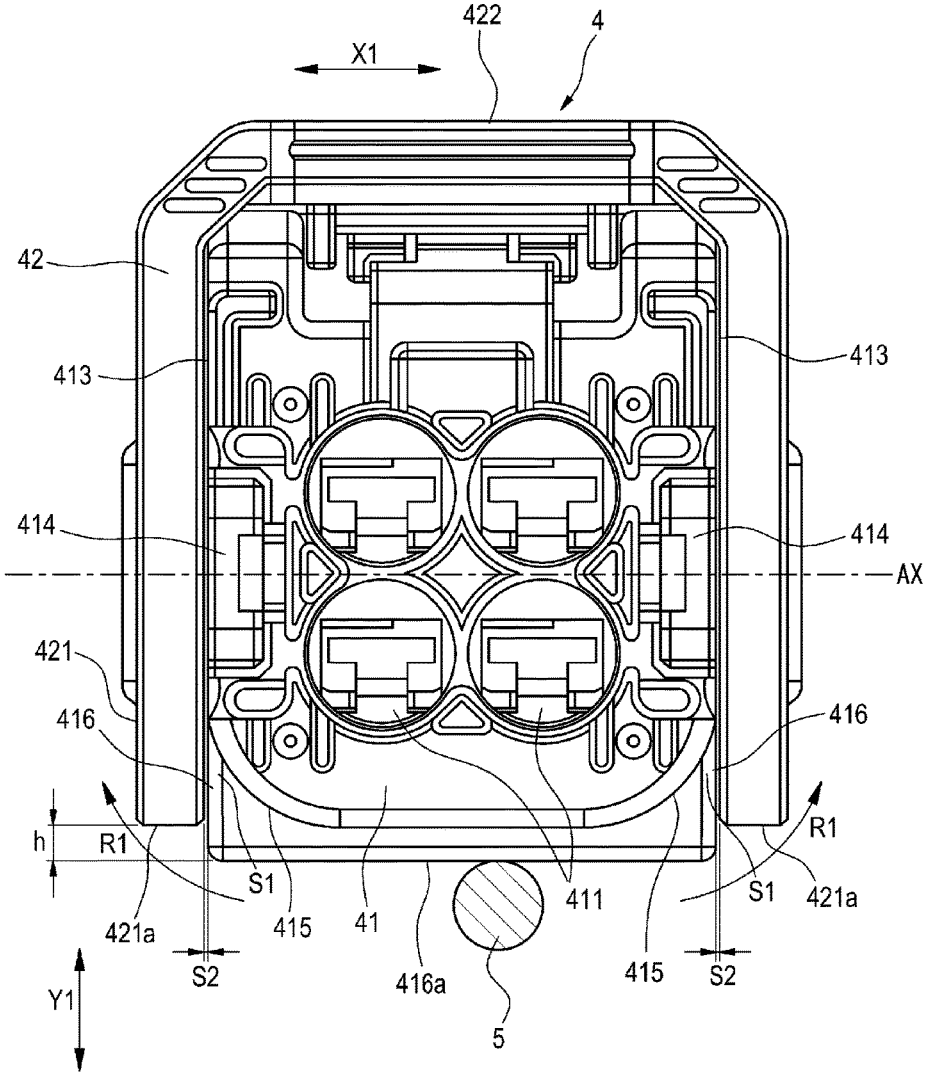
FIG. 2 is a rear view of the connector housing shown in FIG. 1.

FIG. 1 and FIG. 2 show a first embodiment of a connector housing according to the invention. FIG. 1 is a perspective view of the connector housing according to the first embodiment of the invention, as seen obliquely from behind and below. FIG. 2 is a rear view of the connector housing shown in FIG. 1.

The connector housing 4 according to the first embodiment includes a housing body 41 and a fitting operation lever 42. The fitting operation lever 42 is attached to opposite side surfaces of the housing body 41 rotatably.

The housing body 41 includes terminal receiving holes that are disposed therein in two rows and two columns. Cables inserting holes 411 are disposed in two rows and two columns in a rear end of the housing body 41 so that cables connected to terminal fittings received in the terminal receiving holes are inserted into the cable inserting holes 411.

Lever supporting portions 414 are provided in the side surfaces 413 of the housing body 41 so that the lever supporting portions 414 can rotatably support swinging portions 421 of the fitting operation lever 42 which will be described later.

Each of the side surfaces 413 of the housing body 41 has a curved portion 415 provided so that a distance of the curved portion 415 from the swinging portion 421 increases gradually as a distance of the curved portion 415 from a rotary axis AX of the swinging portion 421 of the fitting operation lever 42 increases (in other words, the curved portion 415 provided so that a gap S1 between the curved portion 415 and the swinging portion 421 increases gradually from a position closer to the rotary center of the swinging portion 421 toward a circumferential edge portion of the swinging portion 421).

A plate-like rib 416 that protrudes toward the swinging portion 421 in a width direction of the housing body 41 (a direction along the rotary axis AX of the swinging portion 421, i.e. a direction of an arrow X1 in FIG. 2) is formed in the curved portion 415. The rib 416 is formed into a thick plate shape having a plate thickness t1, as shown in FIG. 1. Further, the rib 416 narrows a gap S2 between the curved portion 415 and the swinging portion 421 to a predetermined value or below. The predetermined value may be set, for example, as a value smaller than a minimum outer diameter of a cable routed around the connector housing 4.

In the case of the embodiment, as shown in FIG. 2, the plate-like rib 416 has a protruding length in a housing height direction (a direction of an arrow Y1 in FIG. 2), that is set so that an outer edge portion 416*a* extending along the width direction of the housing body 41 is located on an outer side (in a down direction in FIG. 2) by a dimension h than an outer circumferential edge 421*a* of the swinging portion 421. In other words, a distance between the outer edge portion 416*a* of the rib 416 and the rotary axis AX of the swinging portion 421 is larger than a distance between the outer circumferential edge 421*a* of the swinging portion 421 and the rotary axis AX of the swinging portion 421.

The fitting operation lever 42 has the pair of left and right swinging portions 421 and an operation rod portion 422. The pair of left and right swinging portions 421 are attached to the side surfaces 413 of the housing body 41 rotatably. The pair of left and right swinging portions 421 are connected to the operation rod portion 422 so that the operation rod portion 422 can serve as an operating portion for swinging the swinging portions 421. Cam grooves are formed in the swinging portions 421 so that connecting pins of a mating housing body can be pulled into the cam grooves in accordance with the swinging.

When the swinging portions 421 of the fitting operation lever 42 are rotated in a state that the housing body 41 and the mating housing body are aligned with each other in a fitting start position, the housing bodies can be fitted to each other.

In the case of the aforementioned connector housing 4 according to the first embodiment, even when a foreign substance 5 (see FIG. 2) such as a cable tends to enter the gap S1 between the curved portion 415 of each side surface 413 of the housing body 41 and the corresponding swinging portion 421 of the fitting operation lever 42, the foreign substance 5 interferes with the rib 416 provided in the curved portion 415 of the side surface 413 of the housing body 41 so that entry of the foreign substance 5 into the gap S1 can be blocked. Accordingly, it is possible to prevent the foreign substance 5 from getting caught between the curved portion 415 of the side surface 413 of the housing body 41 and the swinging portion 421 of the fitting operation lever 42, so that it is possible to prevent the swinging portion 421 from being detached or damaged due to the foreign substance 5 getting caught.

Further, in the case of the connector housing 4 according to the embodiment, the outer edge portion 416*a* of the rib 416 provided protrusively in the curved portion 415 of the side surface 413 of the housing body 41 is located on the outer side by the dimension h than the outer circumferential edge 421*a* of the swinging portion 421 of the fitting operation lever 42. Therefore, for example, the foreign substance 5 such as a cable rubbing against a lower surface of the housing body 41 in the width direction (in the direction of the arrow X1 in FIG. 2) slides on the outer edge portion 416*a* of the rib 416 so as to be apt to move to a position distant from a boundary between the rib 416 and the swinging portion 421, and to be apt to jump over the gap S2 in the boundary between the rib 416 and the swinging portion 421, as designated by an arrow R1 in FIG. 2. Accordingly, the foreign substance 5 can be made harder to enter the gap S1 than in a case where the outer edge portion 416*a* of the rib 416 and the outer circumferential edge 421*a* of the swinging portion 421 are arranged to be flush with each other (a case of FIG. 6 which will be described later). Accordingly, it is possible to more surely prevent the foreign substance 5 from getting caught between the curved portion 415 of the side surface 413 of the housing body 41 and the swinging portion 421 of the fitting operation lever 42.

Further, in the embodiment, when the rib 416 provided in the curved portion 415 is formed into a plate shape having a thickness t1 along a front/rear direction of the housing body 41 and provided only in a portion of the housing body 41 in the front/rear direction, intrusion of the foreign substance can be prevented efficiently.

Second Embodiment

Figure 3:
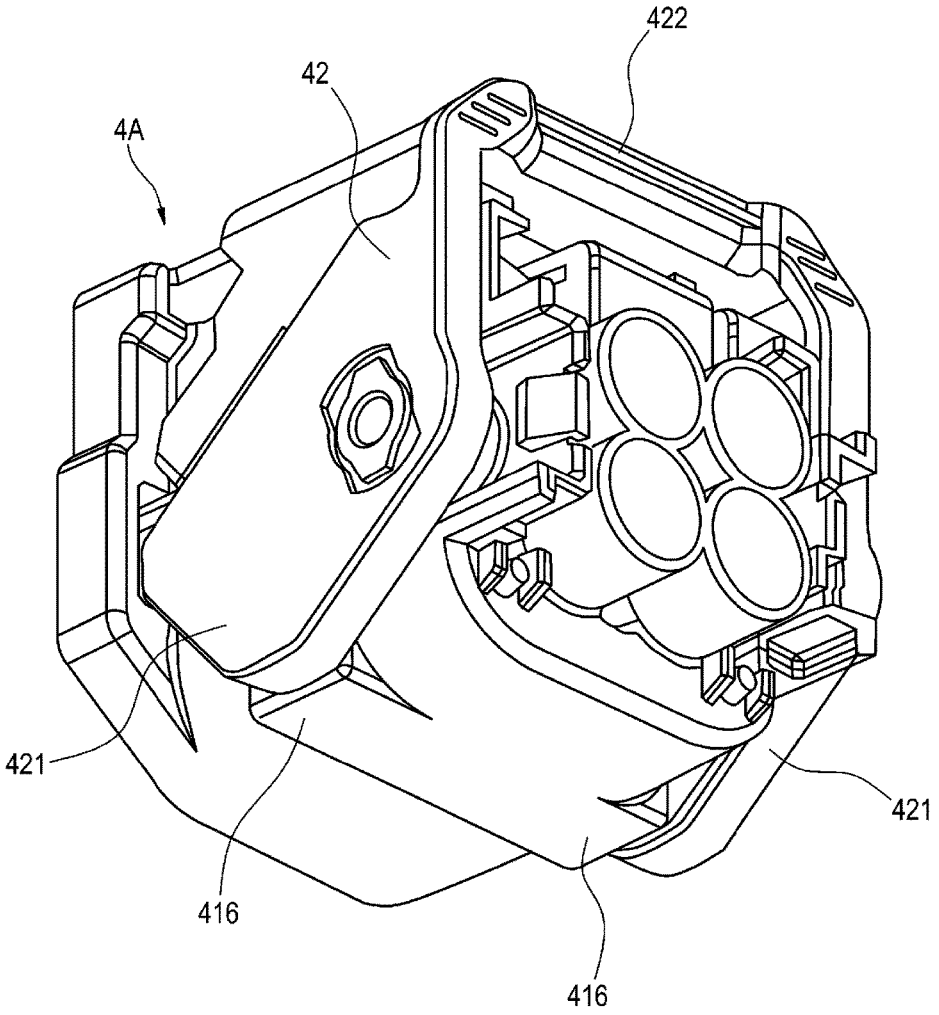
FIG. 3 is a perspective view of a connector housing according to a second embodiment of the invention, as seen obliquely from behind and below.
Figure 4:
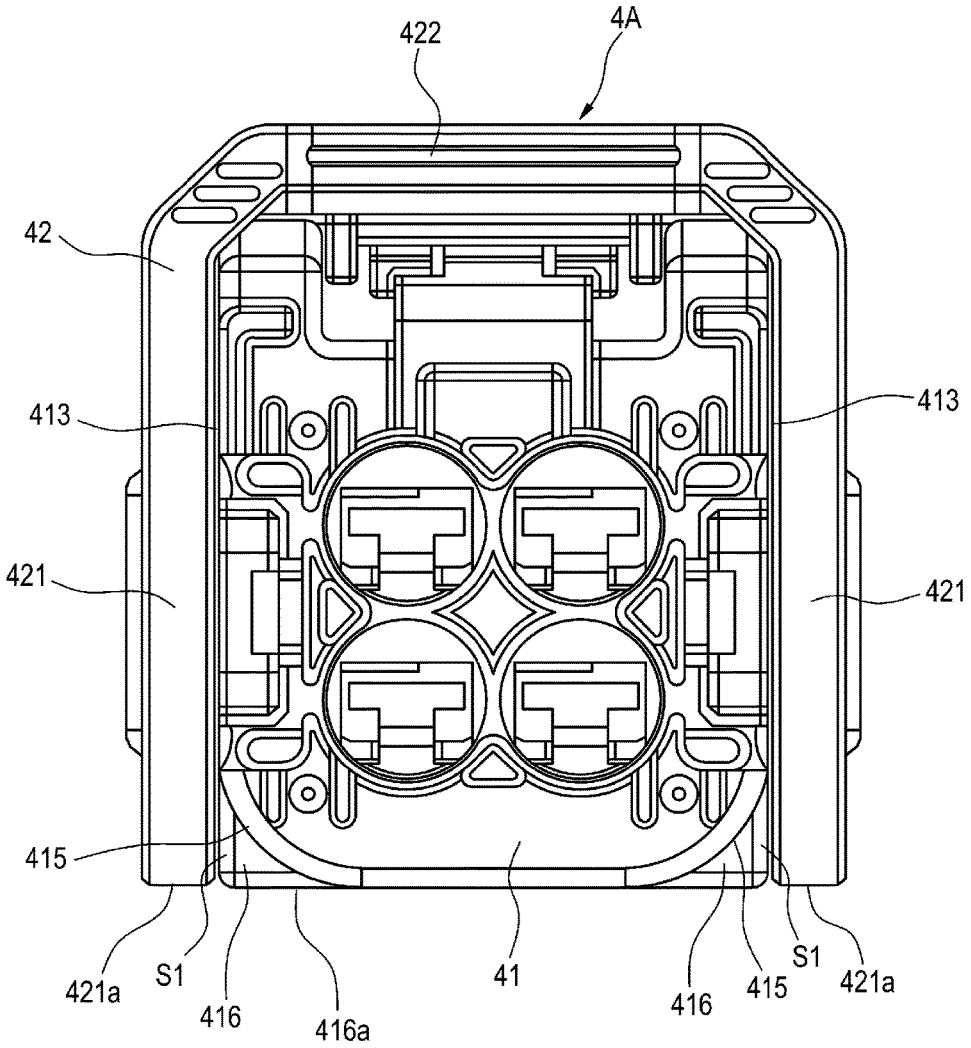
FIG. 4 is a rear view of the connector housing shown in FIG. 3.

FIG. 3 and FIG. 4 show a second embodiment of a connector housing according to the invention. FIG. 3 is a perspective view of the connector housing according to the second embodiment of the invention, as seen obliquely from behind and below. FIG. 4 is a rear view of the connector housing shown in FIG. 3.

In the connector housing 4A according to the second embodiment, the first embodiment is changed partially so that an outer edge portion 416*a* extending in a housing width direction of each rib 416 and an outer circumferential edge 421*a* of each swinging portion 421 can be arranged to be flush with each other. That is, the rib 416 according to the second embodiment has a shorter protruding length in a housing height direction by a height h than the rib 416 according to the first embodiment.

Also in the connector housing 4A according to the second embodiment, a gap S1 between a curved portion 415 of each side surface 413 of a housing body 41 and a corresponding swinging portion 421 of a fitting operation lever 42 is narrowed by the rib 416 provided protrusively in the curved portion 415. Therefore, entry of a foreign substance into the gap S1 can be prevented. Consequently, it is possible to prevent the foreign substance 5 from getting caught in the gap S1 so that it is possible to prevent the swinging portion 421 from being detached or damaged due to the foreign substance 5 getting caught.

Comparative Example

Figure 5:
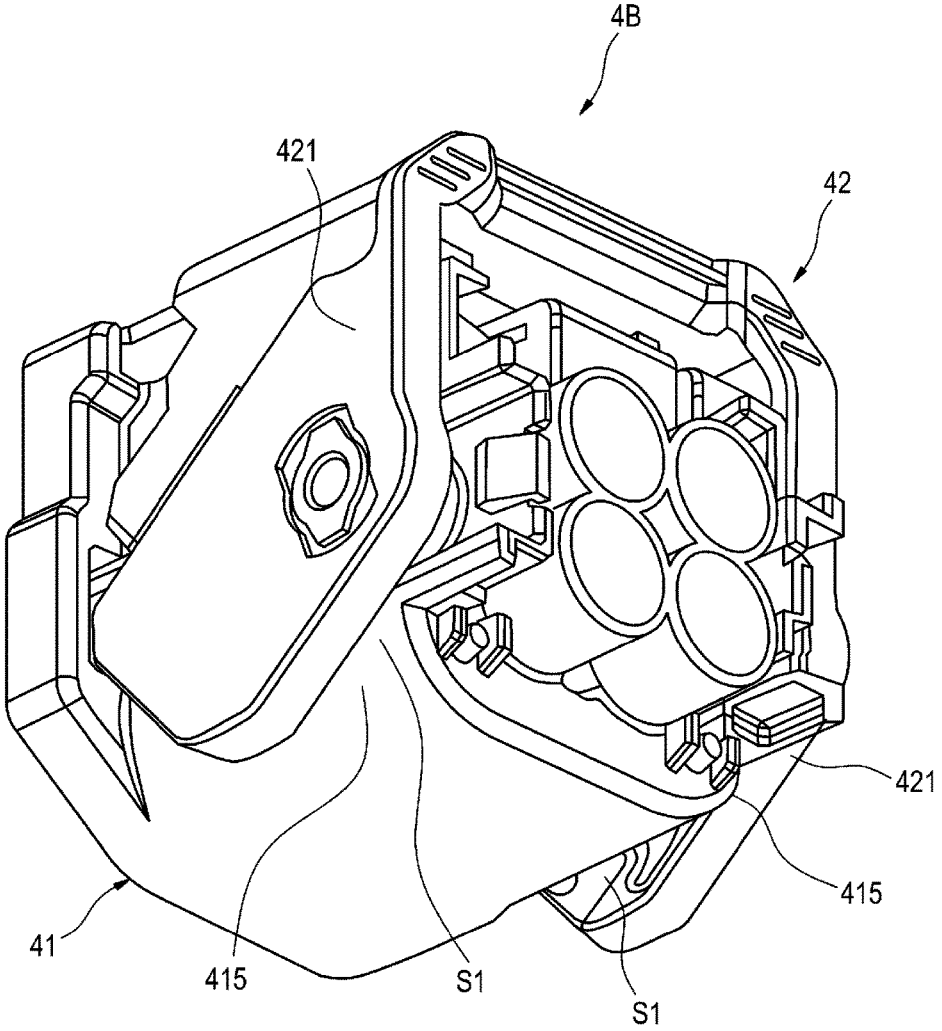
FIG. 5 is a perspective view of a connector housing as a comparative example, as seen obliquely from behind and below, the connector housing having a configuration in which ribs have been removed from the connector housing shown in FIG. 1.
Figure 6:
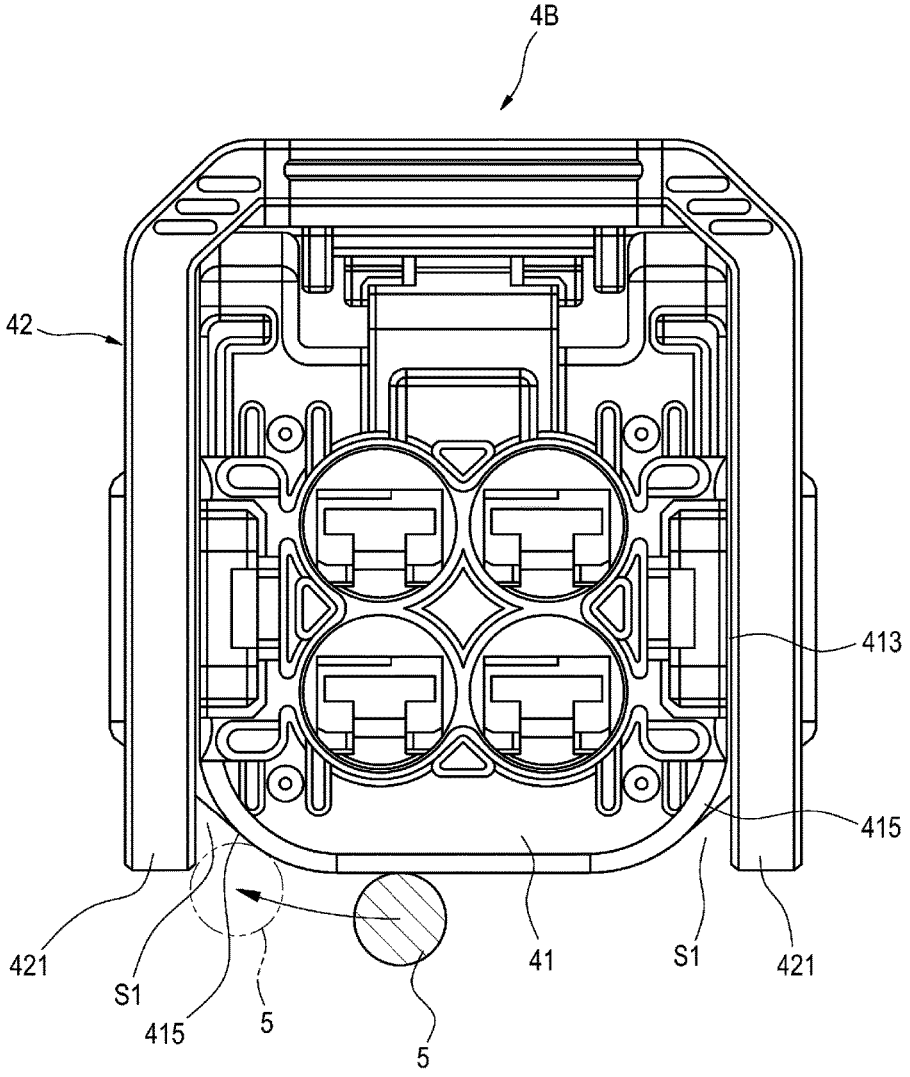
FIG. 6 is a rear view of the connector housing shown in FIG. 5.
Figure 7:
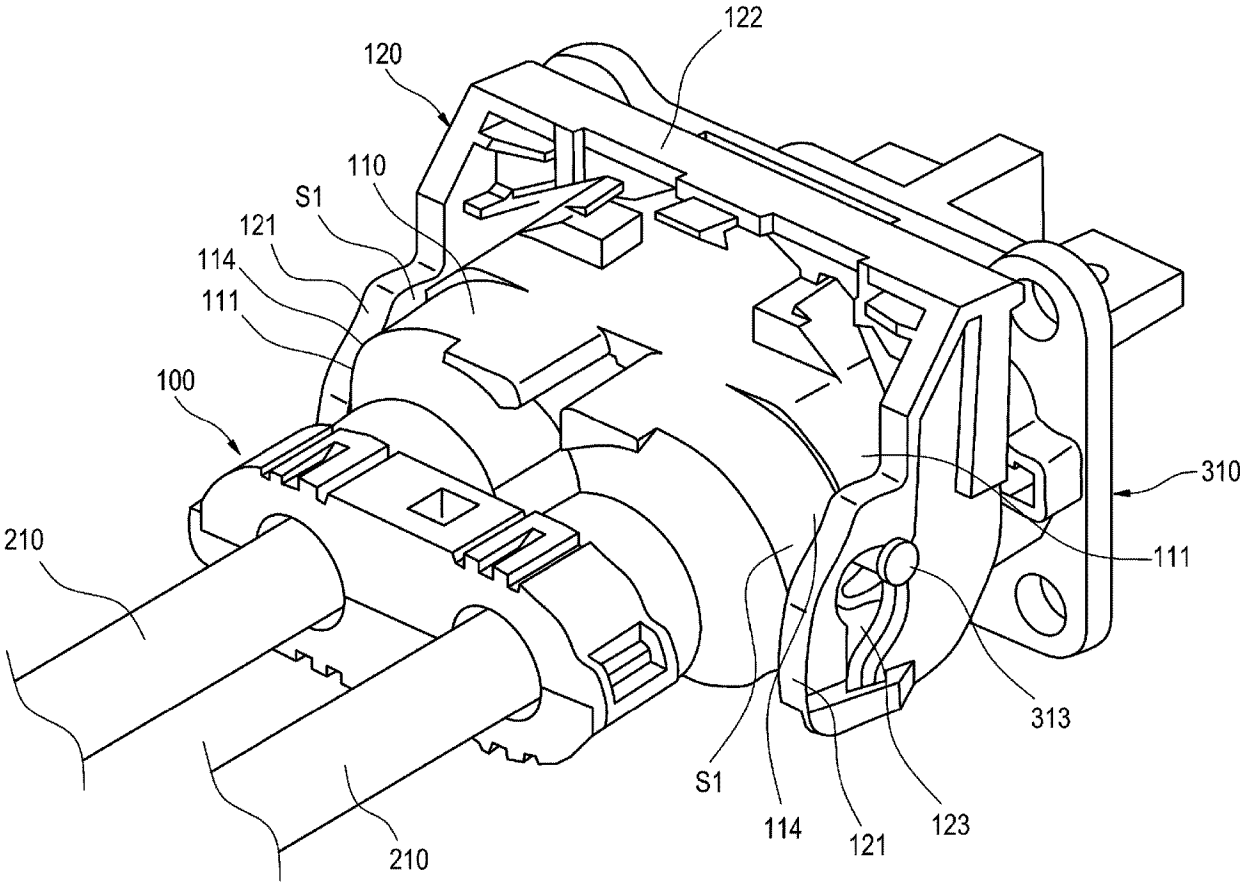
FIG. 7 is a perspective view of a background-art connector housing, as seen obliquely from behind and above.

FIG. 5 and FIG. 6 show a connector housing 4B having a configuration where the ribs 416 have been removed from the connector housing 4 according to the first embodiment. In the case where the ribs 416 are not provided, there is a fear that a foreign substance 5 such as a cable may get caught in a gap S1 between a curved portion 415 of a side surface 413 of a housing body 41 and a swinging portion 421 of a fitting operation lever 42, as shown in FIG. 6. When the foreign substance 5 is sent deep into the gap S1 due to rotation of the swinging portion 421, there is a possibility that detachment and damage etc. of the swinging portion 421 may occur.

The embodiments of the connector housing according to the invention have been described above.

Incidentally, the invention is not limited to the aforementioned embodiments but modification, improvement, etc. can be made thereon suitably. In addition, as long as the invention can be achieved, the materials, shapes, dimensions, numbers, arrangement places, etc. of the respective constituent members in the aforementioned embodiments are not limited but can be changed desirably.

For example, the rib 416 may be provided not in only one place in the middle of the housing in the front/rear direction (a direction perpendicular to the rotary axis AX of the swinging portion 421) but in a plurality of places separated from one another in the front/rear direction of the housing.

Here, the aforementioned characteristics of the embodiments of the connector housing according to the invention are summarized briefly and listed in the following paragraphs (1) and (2) respectively.

A connector housing including:

a housing body (41); and a fitting operation lever (42) that has a swinging portion (421) attached to a side surface of the housing body rotatably so that when the swinging portion is rotated in a state that the housing body and a mating housing body are aligned with each other in a fitting start position, the housing body (41) and the mating housing body can be fitted to each other, wherein the housing body (41) has a curved portion (415) and a rib (416) that are provided in the side surface (413) of the housing body, the curved portion being provided so that a distance of the curved portion from the swinging portion increases as a distance of the curved portion from a rotary axis (AX) of the swinging portion (421) increases, the rib protruding from the curved portion toward the swinging portion and therefore narrowing an interval between the curved portion and the swinging portion to a predetermined value or below.

(2) The connector housing according to the aforementioned paragraph (1), wherein a distance between an outer edge portion (416*a*) of the rib and the rotary axis (AX) of the swinging portion (421) is larger than a distance between an outer circumferential edge (421*a*) of the swinging portion and the rotary axis (AX) of the swinging portion (421).

According to the invention, it is possible to prevent a foreign substance from getting caught between the curved portion of the side surface of the housing body and the swinging portion of the fitting operation lever so that it is possible to prevent the fitting operation lever from being detached and damaged due to the foreign substance getting caught. The invention that can obtain the effect is useful for a connector housing.

What is claimed is:

1. A connector housing comprising:

a housing body; and a fitting operation lever that has a swinging portion attached to the housing body rotatably so that when the swinging portion is rotated in a state that the housing body and a mating housing body are aligned with each other in a fitting start position, the housing body and the mating housing body are fitted to each other, wherein the housing body includes a side surface having a curved portion, a lower surface continuous from the side surface, and a rib, the swinging portion being attached to the side surface, the curved portion being provided so that a distance of the curved portion from the swinging portion increases as a distance of the curved portion from a rotary axis of the swinging portion increases, the rib protruding from the curved portion and the lower surface;

wherein a part of the rib protruding toward the swinging portion narrows an interval between the curved portion and the swinging portion to a predetermined value or below;

wherein a part of the rib protruding toward a direction separating from the lower surface has one flat face which continuously extends between both side surfaces of the housing body; and wherein a distance between the rotary axis of the swinging portion and the flat face of the rib is larger than a distance between the rotary axis of the swinging portion and a part of an outer circumferential edge of the swinging portion being closest to the flat face of the rib.

2. A connector housing comprising:

a housing body; and a fitting operation lever that has a pair of swinging portions attached to both side surfaces of the housing body rotatably so that when the pair of swinging portion are rotated in a state that the housing body and a mating housing body are aligned with each other in a fitting start position, the housing body and the mating housing body are fitted to each other, wherein each of the both side surfaces of the housing body has a curved portion being provided so that a gap between the side surface and the swinging portion gradually increases toward a circumferential edge of the swinging portion from a position near a center of a rotary axis of the swinging portion;

wherein a pair of ribs protruding toward the pair of swinging portions along a width direction of the housing body are provided on the curved portions of the both side surfaces so as to narrow gaps between each of the curved portions and each of the swinging portions to a predetermined value or below;

wherein one flat face continuously extends in the width direction of the housing body is configured by outer edge faces of the pair of ribs and outer edge face of the housing body positioned between the outer edge portions of the pair of ribs; and wherein each of the outer edge faces of the pair of ribs and the circumferential edge of the corresponding swinging portion are aligned in the width direction of the housing body so as to be flush with each other.

* * * * *